United States Patent [19]

Le Blanc

[11] 4,204,815

[45] May 27, 1980

[54] CARTRIDGE ROTARY VANE PUMP

[75] Inventor: Joseph A. Le Blanc, Glen Ellyn, Ill.

[73] Assignee: Gast Manufacturing Corporation, Benton Harbor, Mich.

[21] Appl. No.: 858,017

[22] Filed: Dec. 6, 1977

[51] Int. Cl.[2] ..... F04C 27/02; F04C 23/00

[52] U.S. Cl. ..... 418/13; 418/96; 418/213

[58] Field of Search ..... 418/13, 96, 212, 213, 418/215, 270, 210, 70, 60, 3, 5; 403/343, 296

[56] References Cited

U.S. PATENT DOCUMENTS

| | | | |
|---|---|---|---|
| 1,672,205 | 6/1928 | Eisler | 418/13 |
| 1,714,818 | 5/1929 | Reed | 403/343 X |
| 2,902,210 | 9/1959 | Power | 418/13 |
| 3,237,851 | 3/1966 | Le Blanc, Jr. | 418/13 |
| 3,399,826 | 9/1968 | Andriulis | 418/96 X |
| 3,525,578 | 8/1970 | Le Blanc, Jr. | 418/13 |
| 3,620,656 | 11/1971 | Sharples | 418/60 X |
| 3,838,950 | 10/1974 | Andriulis | 418/96 X |
| 3,901,631 | 8/1975 | Wickham | 418/270 X |

*Primary Examiner*—Leonard E. Smith

[57] ABSTRACT

A rotary vane vacuum pump includes a drive unit, such as an electric motor, and a pump unit, preferably constructed as a cartridge pump unit. The drive unit may take any suitable form, but the cartridge unit includes one or more pumping stages plus a pumping stage of small dimension to lower pressure and increase outgassing of the lubricant. The rotors of the rotary vane pump unit are shaftless, that is they together form an axis of rotation without a separate axial shaft and are thus simplified in construction. All of the requirements of oiling, outgassing and gas ballast are fulfilled in the additional stage.

11 Claims, 13 Drawing Figures

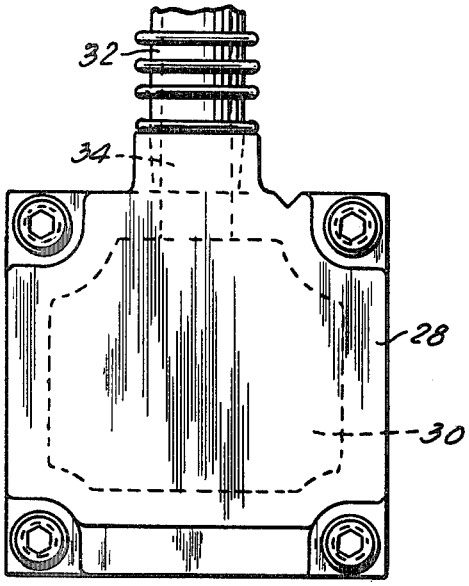
Fig. 5
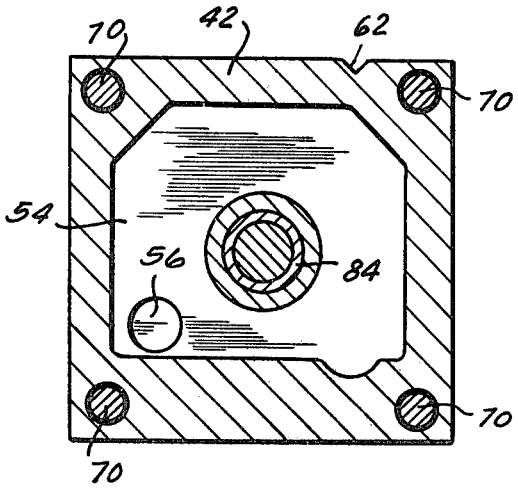
Fig. 6
Fig. 7
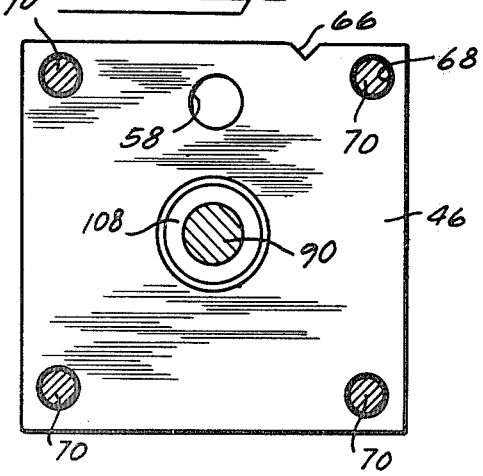
Fig. 8
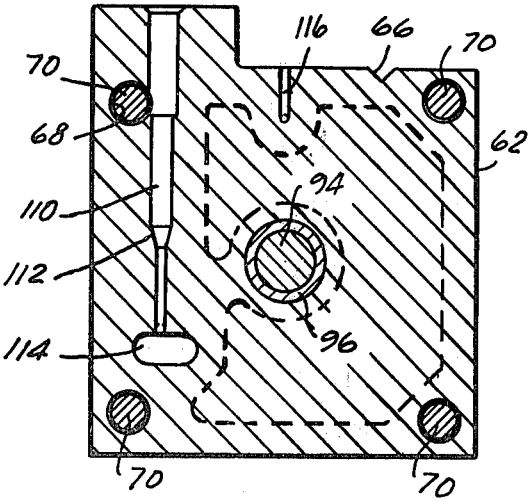

Fig. 9
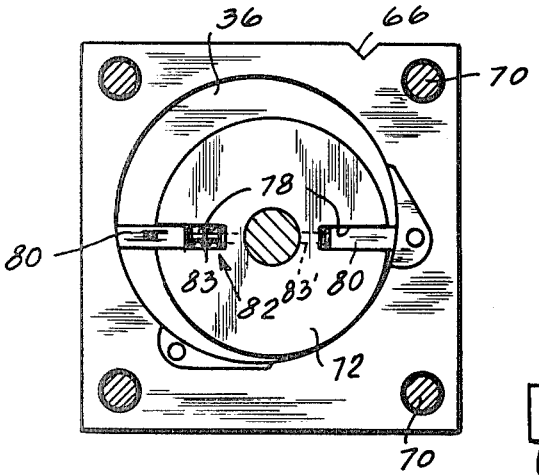
Fig. 10
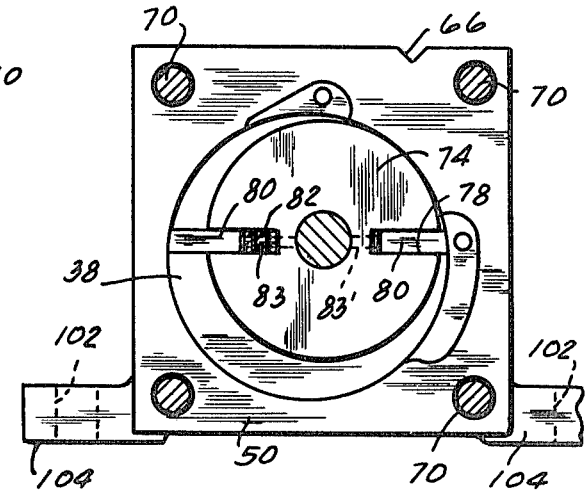
Fig. 11
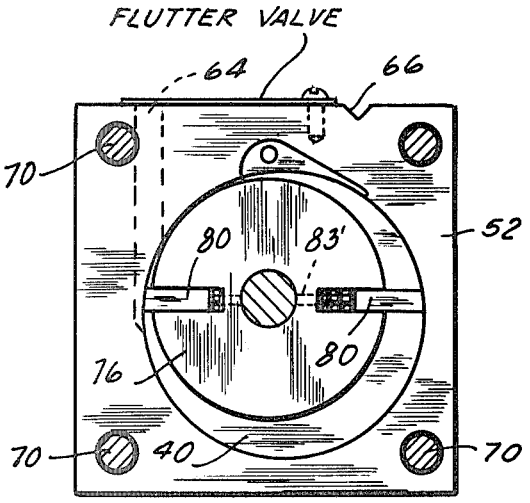
Fig. 12
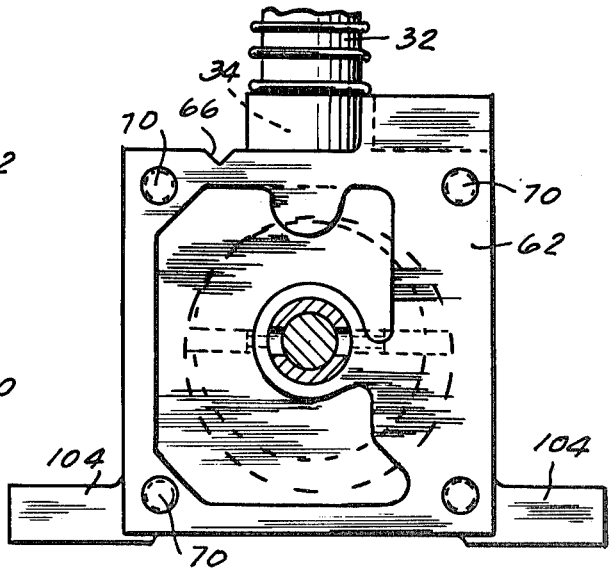
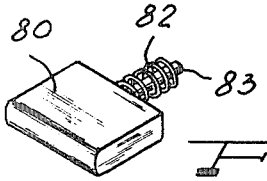
Fig. 13

CARTRIDGE ROTARY VANE PUMP

BACKGROUND OF THE INVENTION

1. Field of the Invention

The present invention relates to rotary vane pumps, and is particularly concerned with high vacuum rotary vane pumps which may be simply constructed in cartridge form.

2. Background of the Invention

The construction of rotary vane pumps is wide and varied, but basically all such pumps include one or more rotors which are rotatable in a like number of eccentrically disposed, serially connected pumping chambers which define a low pressure output side of the pump.

Various techniques for improving pump operation and pumping efficiency have heretofore been devised. For example, in my earlier U.S. Pat. No. 3,782,868, entitled "Rotary Vane Pump" I disclose structure for noise free lubrication of the pump.

In present high vacuum pumps oil for lubrication and leakage sealing is permitted to enter, in fact is drawn into, the exhaust stage of a pump and, due to occluded gasses, adversely affects the pressure of the inlet stage to an intolerable degree.

SUMMARY OF THE INVENTION

The primary object of the invention is to provide a new and improved rotary vane vacuum pump.

Another object of the invention is to provide a vacuum pump of simple construction which may be constructed as a cartridge type pump.

A particular object of the invention is to provide a pump cartridge which is readily adaptable to a plurality of pump structures. More specifically, this object includes the desire to provide an easily manufactured and assembled pump cartridge structure.

Another object of the invention is to provide a rotary vane vacuum pump which is virtually noise free, with respect to outgassing of the lubricant, without requiring special additional structures for noise suppression.

According to the invention, a pump of one or more stages, hereinafter referred to as 1+, 2+, etc. stages, is provided with an additional stage, the (+) stage, of small axial dimension, whereby oil which is permitted to enter the inlet cycle becomes exposed to lower than normal pressure, thereby increasing the outgassing rate. This degassed oil is, in turn, flowed through the common stages allowing the pump to reach lower pressures at an increased rate of time.

Another feature of the invention is to provide, by way of the additional (+) stage, a constant gas ballast (air entering the exhaust cycle to cleanse the lubricating oil) without adversely affecting the ultimate pressure of the pump. Also, a variable gas ballast with a more finite control should be provided.

According to another feature of the invention, the additional stage, the (+) stage, permits a high vacuum rotary pump to be constructed in cartridge form with more reliable results.

Another feature of the invention is to provide a rotor structure which may be easily and simply constructed, preferably without a rotor shaft. In this preferable construction each rotor includes a central, axially extending threaded section which is received in an axial, threaded bore of an associated section of the adjacent rotor.

BRIEF DESCRIPTION OF THE DRAWINGS

Other objects, features and advantages of the invention, its organization, construction and operation will become apparent and the invention will be best understood from the following detailed description, taken with the accompanying drawings, on which:

FIG. 5 is a trap-end view of the cartridge of FIG. 3 taken along the line V—V;

FIG. 6 is a sectional view taken along the line VI—VI of FIG. 3;

FIG. 7 is a sectional view taken along the line VII—VII of FIG. 3;

FIG. 8 is a sectional view taken along the line VIII—VIII of FIG. 3;

FIG. 9 is a sectional view taken along the line IX—IX of FIG. 3;

FIG. 10 is a sectional view taken along the line X—X of FIG. 3;

FIG. 11 is a sectional view of the structure taken along the line XI—XI of FIG. 3;

FIG. 12 is a drive end view taken along the line XII—XII of FIG. 3; and

FIG. 13 is a perspective view of the vane structure.

DESCRIPTION OF THE PREFERRED EMBODIMENTS

Figure 1:
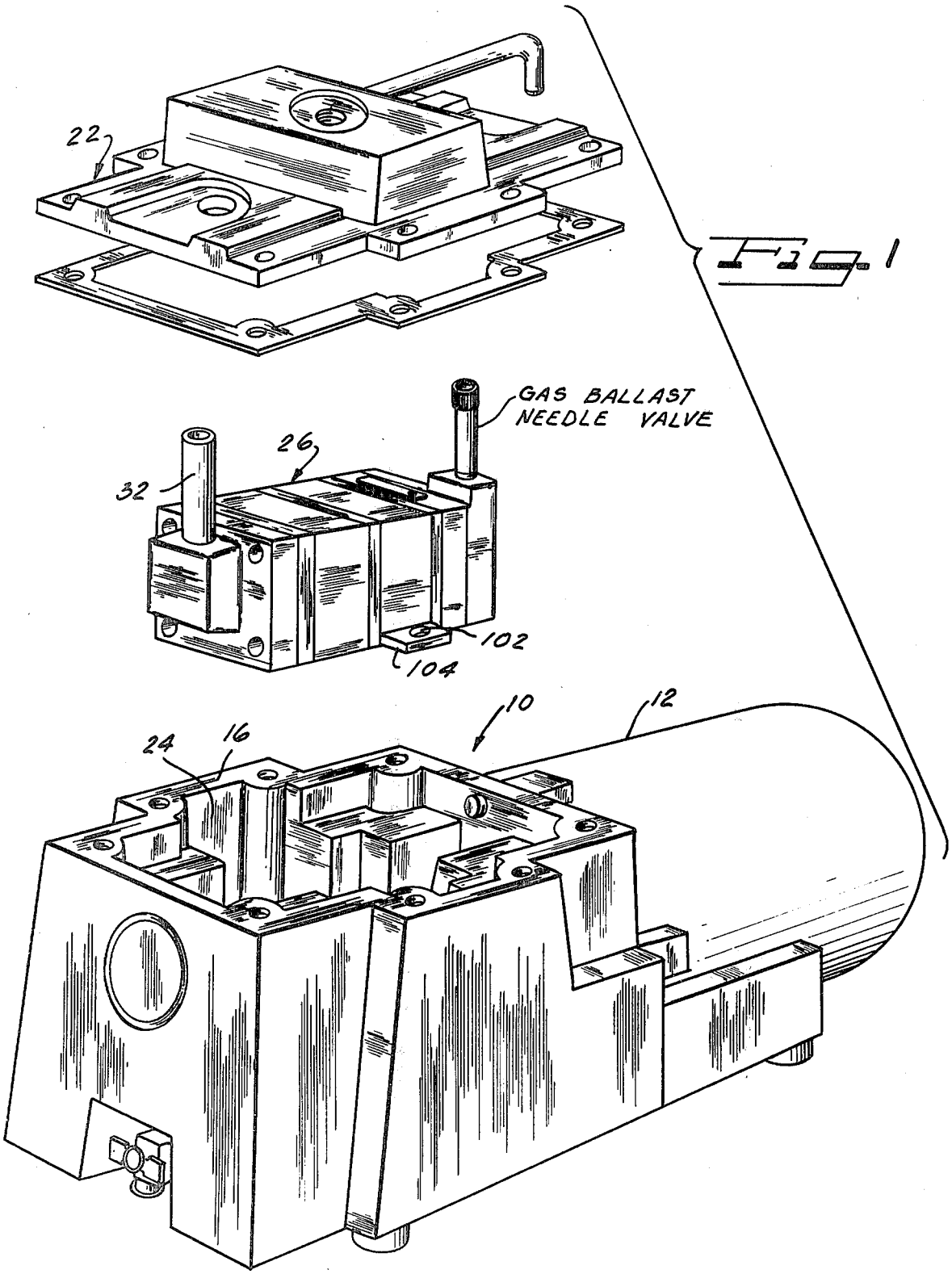
FIG. 1 is a perspective view of a pump constructed in accordance with the present invention.
Figure 2:
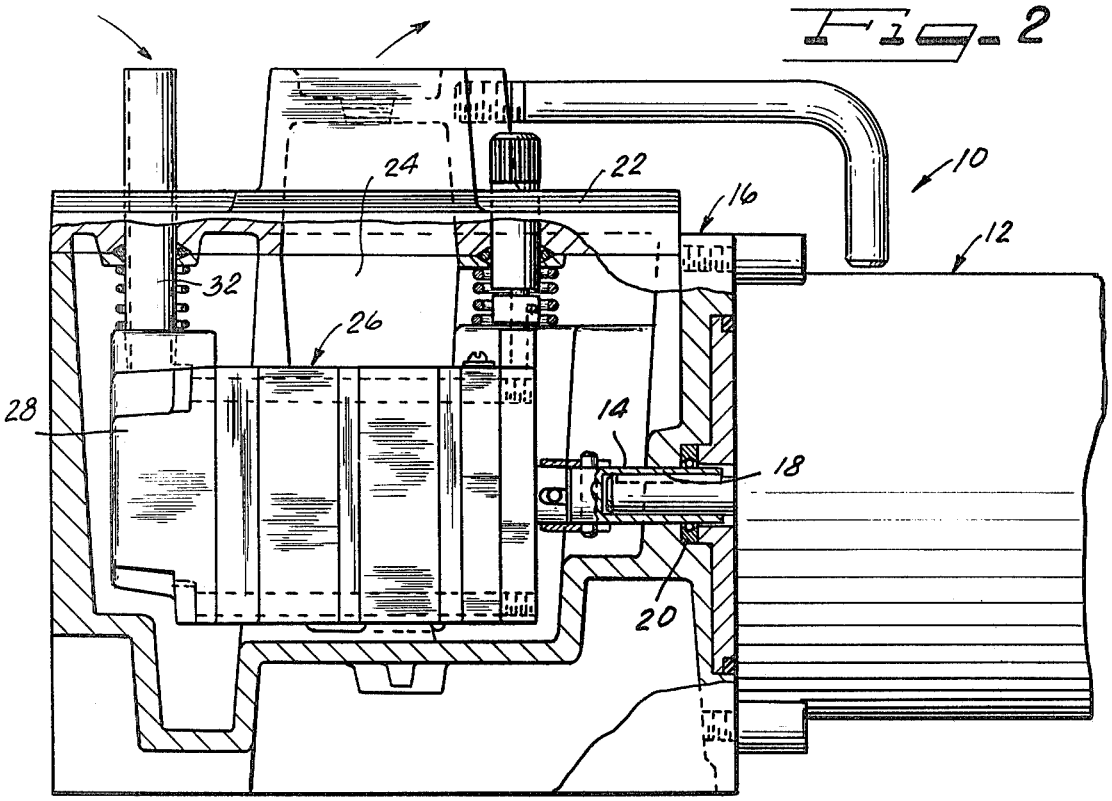
FIG. 2 is an elevational sectional view of a pump constructed in accordance with the present invention.
Figure 3:
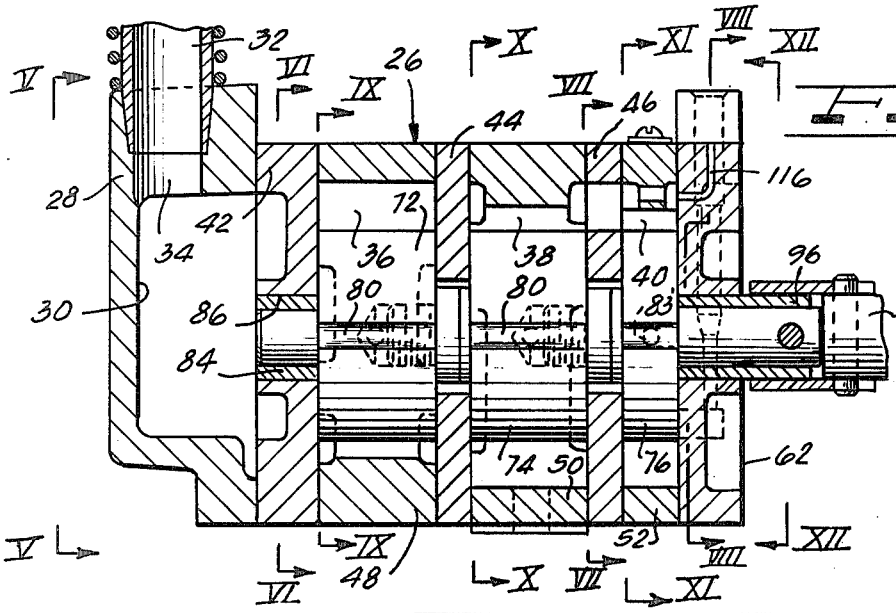
FIG. 3 is an elevational sectional view of a cartridge of a pump constructed in accordance with the invention.

Referring to FIGS. 1, 2, and 3, a pump 10 that is an electric motor, is illustrated as comprising a prime mover 12, having an output shaft 14 which extends into a pump housing 16 through an aperture 18 via a seal 20.

The housing 16 has a cover 22 and together therewith defines a chamber 24 which receives and mounts therein a pump cartridge 26. The pump cartridge 26 includes a first end plate 28 (FIGS. 2 and 5) having a recess 30 therein which is in fluid communication with a conduit 32 through a port 34 (also see FIG. 13). In the specific embodiment illustrated three pumping chambers 36, 38, and 40 are connected in fluid communication with the recess 30, as illustrated in FIGS. 6–11, respectively, by way of a plurality of stators 48, 50, and 52 and a plurality of intermediate plates 42, 44, and 46, each of which stators and intermediate plates include bores therethrough.

Each of the chambers 36, 38, and 40 are defined by respective bores in respective stators 48, 50, and 52 while: the plate 42 (FIG. 6) includes a recess 54 and a bore 56 communicating between the recess 30 and the chamber 36; the plate 44 includes a bore (not shown) communicating the chamber 36 with the chamber 38; and the plate 46, an outgassing exhaust end plate, includes a bore 58 communicating the chamber 38 with a port 114 in an end plate 62 (FIG. 8) via the chamber 40, and with a port 64 in the stator 52 (FIG. 11). Each of the bores in the stators communicates through recesses relieved in the faces of the stators, as is common practice. Each of the plates and stators includes a notch 66 (see FIGS. 8 and 9 for example) therein for alignment during assembly and each includes a plurality of bores 68 for receiving a fastener 70 therein such as a bolt, rivit or the like.

The pumping chamber 36 in the stator 48 has a rotor 72 therein; the pumping chamber 38 in the stator 50 has a rotor 74 therein; and the pumping chamber 40 in the stator 52 has a rotor 76, the (+) rotor, therein. As illustrated, for example, FIG. 10, each of the rotors 72, 74, and 76 has at least one radially directed slot 78 therein which receives a slideable vane 80 which is spring loaded, as at 82, (FIG. 5) the spring 82 being on a pin 83 received in a bore 83.

Figure 4:
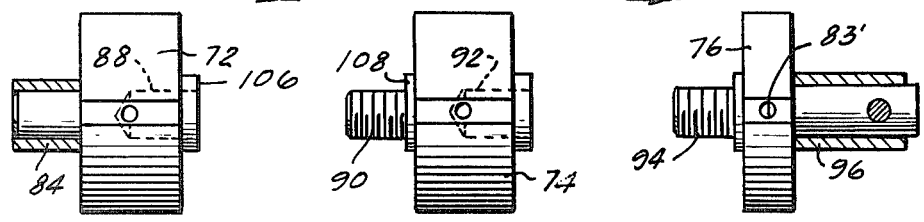
FIG. 4 is an exploded view of a 2+1 pump rotor according to the invention.

Referring to FIG. 4, a particular feature of the invention is illustrated, in the context of the embodiment of FIGS. 1, 2, and 3. In FIG. 4, a first rotor 72 is illustrated as including an axial projection 84 for rotational reception in a bore 86 in the plate 42 and a threaded axial recess 88 for receiving a threaded axial projection 90 of the rotor 74. The rotor 74 also includes a threaded axial bore 92 which receives a threaded projection 94 of the rotor 76 which also has an axial projection 96 which is adapted at 98 for driving connection to the output shaft 14 of the prime mover 12. The rotors are therefore constructed for a shaftless assembly which greatly simplifies assembly and final machining of the components.

After assembly of the cartridge 26, the same may be coupled to the drive shaft 14 and removably mounted in the chamber 24, as illustrated in FIG. 2, a pair of machine screws (not shown) which extend downwardly through a pair of bores 102 in a pair of bosses 104 as seen in FIGS. 1, 10, and 12.

As shown in FIG. 4, each of the rotors has at least one axial projection or collar 106 which abuts a facing collar 108 of the adjacent rotor to space the rotors so as to receive the imtermediate plates therebetween. It is readily apparent from the structure of FIGS. 3 and 4 that finishing and balancing of a rotor assembly is greatly simplified by the present invention in that there is no rotor shaft per se as a separate part and therefore no force fit of rotors on a shaft and no cracking or rotor-shaft slippage. If the rotor assembly is to be driven from the intake end, opposite thread direction may be used.

As previously mentioned, high vacuum pumps require oil for lubrication. In the present invention the chamber 24 may advantageously be a reservoir for lubricating oil as well as a repository for the cartridge 26. The added stage, the (+) stage including the rotor 76, which permits the oil to enter the cartridge through a passageway 116 in the end plate 62 during the inlet cycle, creates an extremely low pressure in the exhaust stage and exposes the lubricating oil to this pressure to increase outgassing. The degassed oil then is flowed through all of the small spaces of the cartridge for lubrication of the stages. A constant gas ballast (air entering the exhaust cycle to cleanse the oil) is therefore established without adversely affecting the ultimate pressure of the pump. This ballast may be adjusted by a needle valve (not shown) in the valve passageway 110 in FIG. 8 which has a valve seat 112 in communication with a slot 114 which extends to the exterior of the cartridge.

In summary, the oiling, gas ballast and degassing requirements of high vacuum rotary vane pumps have been provided in a pump, in particular a pump cartridge, not in a manner heretofore conventional where each requirement was fulfilled at various locations in a pump, but uniquely all requirements are met in a single stage, the (+) stage. This novel construction advantageously lends itself to cartridge form and the unique cartridge structure, including the novel rotor arrangement, simplifies production and makes refurbrishing fast, easy and economical.

Although I have described my invention by reference to a particular illustrative embodiment thereof, many changes and modifications may become apparent to those skilled in the art without departing from the spirit and scope of the invention. I therefore intend to include within the patent warranted hereon all such changes and modifications as may reasonably and properly be included within the scope of my contribution to the art.

I claim as my invention:

1. A high vacuum rotary vane pump, comprising:
a prime mover including a rotary output;
a pump housing connected to said prime mover and defining a first chamber for containing a lubricant; and
a pump cartridge mounted in said first chamber, said pump cartridge comprising a pump cartridge housing defining an inlet, an outlet and at least two pumping chambers respectively adjacent said inlet and outlet, one of said chambers being of less axial dimension than the other of said chambers, at least two serially-connected rotors, rotatably mounted in said chambers and coupled to said rotary output of said prime mover, of complementary axial dimension to and disposed within said one chamber and the other rotor being of complemental axial dimension to and disposed within said other chamber,
a first of said rotors including an axially extending threaded projection and a second of said rotors including an axially extending threaded bore receiving said threaded projection for a driving interconnection of said rotors,
at least one of said rotors including an axially projecting collar for engaging the other of said rotors to provide a predetermined axial spacing of said rotors.

2. In a rotary vane pump of the type in which a plurality of serially-connected vane carrying rotors are rotatably mounted in a plurality of fluid-connected pumping chambers and in which there is a pump fluid inlet, a pump fluid outlet and a rotary input to the series of rotors, the improvement wherein:
each of said rotors is directly connected to each adjacent rotor, whereby the conventional rotor shaft is eliminated,
each of said rotors includes at least one axially-threaded portion for threaded engagement with a complementary axially-threaded portion of an adjacent rotor, and
at least one spacer integral with one of said adjacent rotors to provide a predetermined axial spacing of said rotors.

3. The improved pump of claim 2, wherein each of said rotors, with the exception of the end rotors, includes a threaded axial projection and an oppositely facing threaded axial bore for threadedly receiving the threaded axial projection of an adjacent rotor.

4. A rotary vane pump comprising:
a prime mover including a rotatable output shaft;
a plurality of pumping chambers serially-connected in fluid communication, one of said pumping chambers including a fluid inlet and another of said chambers including a fluid outlet;
a plurality of serially-connected rotary vane rotors connected to said rotatable output shaft, each of said rotors disposed in a respective pumping chamber;

a first end one of said rotors including a threaded axial projection, a second end one of said rotors including a threaded axial bore, and the rotors between said first and second end rotors including both a threaded axial projection and an oppositely facing threaded axial bore, said series-connected rotors interconnected by threaded engagement of the axial projection and axial bore of adjacent rotors, at least one of each two adjacent rotors further including an integral spacer for engaging the other adjacent rotor to provide a predetermined axial spacing of said rotors;

a lubricating reservoir enclosing said pumping chambers for providing a lubricant to the moving parts of said pump; and means connecting one of said pumping chambers in fluid communication with said reservoir and in fluid communication with the exterior, including ballast valve means, for creating a low pressure to increase outgassing and for introducing air in the exhaust cycle to cleanse the lubricant.

5. The rotary vane pump of claim 4, comprising:

a pump cartridge housing removably mounted within said lubricating reservoir and defining said pumping chambers.

6. A high vacuum rotary vane pump comprising:

a plurality of pumping stages which are connected in series between a pump inlet and a pump outlet, each of said stages including a stator defining a pumping chamber, and a sliding-vane type rotor in said chamber, each of said rotors between the end rotors of the series including first and second oppositely facing axially threaded elements each for engagement with the adjacent threaded element of the adjacent rotor, with one of the end rotors including said first threaded element and the other of said end rotors including the second threaded element for threaded engagement with the respective adjacent rotors, for driving interconnection of said rotors in series;

at least one of each two adjacent rotors including an integral spacer for engaging the other adjacent rotor upon interconnection to provide a predetermined axial spacing of said rotors;

an oil reservoir for holding lubricating oil for the pump; and one of said pumping stages comprising oiling means for connecting said reservoir to its pumping chamber during an inlet cycle to draw in lubricating oil, ballast means including a ballast valve for connecting said chamber to the exterior of the pump during an exhaust cycle to control the amount of cleansing air for the lubricating oil, and outgassing means for subjecting the lubricating oil to a lowered pressure to increase outgassing of the oil.

7. The pump of claim 6, wherein said one pumping stage comprises an end plate including passageways therethrough, said ballast valve in one of said passageways, and wherein said chamber, said valve and said passageways constitute said oiling, ballast and outgassing means.

8. A pump cartridge for a cartridge pump, said pump cartridge comprising:

a cartridge housing including chamber means defining a plurality of pumping chambers which are serially-connected in fluid communication;

a fluid inlet at a first end one of said pumping chambers;

a fluid outlet at a second end one of said pumping chambers; and a plurality of serially-connected rotors mounted for rotation about an axis in respective ones of said chambers, one of said rotors at one of said ends of said chambers adapted to receive a rotary input, and each of said rotors including interengagement means connecting that rotor to each adjacent rotor, said interengagement means including, with respect to adjacent rotors, an axially-projecting threaded stud on one of said adjacent rotors and an axially-aligned threaded bore in the other of said adjacent rotors for threadingly engaging said threaded stud to provide interengagement of said adjacent rotors, and at least one of said adjacent rotors including an axially projecting collar for engaging the other of said adjacent rotors to provide a predetermined axial spacing of said adjacent rotors.

9. The pump cartridge of claim 8, wherein said cartridge housing comprises:

a plurality of end plates journaling said rotors for rotation;

a plurality of pump stator plates each including a bore in which the respective rotor is disposed;

a center plate intermediate adjacent stator plates defining, with said stators and end plates, said pumping chambers.

10. The pump cartridge of claim 9, wherein:

each of said end, center and stator plates having similar peripheral dimensions and alignment indicia for proper orientation thereof during assembly.

11. The pump cartridge of claim 10, wherein:

said indicia comprises an identical notch in each plate forming a continuous groove across all of said plates.

* * * * *